US007217089B2

(12) United States Patent
Durocher et al.

(10) Patent No.: US 7,217,089 B2
(45) Date of Patent: May 15, 2007

(54) GAS TURBINE ENGINE SHROUD SEALING ARRANGEMENT

(75) Inventors: Eric Durocher, Vercheres (CA); Martin Jutras, St. Amable (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 168 days.

(21) Appl. No.: 11/034,764

(22) Filed: Jan. 14, 2005

(65) Prior Publication Data

US 2006/0159549 A1 Jul. 20, 2006

(51) Int. Cl.
*F01D 11/00* (2006.01)

(52) U.S. Cl. ..... 415/174.2; 415/170.1

(58) Field of Classification Search ..... 415/170.1, 415/173.1, 173.3, 173.6, 174.2
See application file for complete search history.

(56) References Cited

U.S. PATENT DOCUMENTS

| | | | | |
|---|---|---|---|---|
| 3,394,919 | A | 7/1968 | Catterfeld | |
| 3,730,640 | A | 5/1973 | Rice et al. | |
| 3,825,365 | A | 7/1974 | Peng | |
| 4,318,668 | A | 3/1982 | Chaplin et al. | |
| 4,573,866 | A | 3/1986 | Sandy, Jr. et al. | |
| 5,333,995 | A | 8/1994 | Jacobs et al. | |
| 5,479,772 | A | 1/1996 | Halila | |
| 5,562,408 | A | 10/1996 | Proctor et al. | |
| 5,669,757 | A | 9/1997 | Brackett | |
| 5,738,490 | A | 4/1998 | Pizzi | |
| 5,988,975 | A | 11/1999 | Pizzi | |
| 6,076,835 | A | 6/2000 | Ress et al. | |
| 6,164,656 | A | 12/2000 | Frost | |
| 6,402,466 | B1 | 6/2002 | Burdgick et al. | |
| 2004/0047725 | A1* | 3/2004 | Tomita et al. | 415/116 |
| 2006/0083607 | A1* | 4/2006 | Synnott et al. | 415/173.1 |

* cited by examiner

*Primary Examiner*—Edward K. Look
*Assistant Examiner*—Nathan Wiehe
(74) *Attorney, Agent, or Firm*—Ogilvy Renault LLP

(57) ABSTRACT

A ring seal is mounted in the annular gap between a shroud platform overhanging portion and the surrounding shroud support to minimize cooling air leakage through the shroud.

9 Claims, 2 Drawing Sheets

GAS TURBINE ENGINE SHROUD SEALING ARRANGEMENT

TECHNICAL FIELD

The invention relates generally to gas turbine engine and, more particularly, to a new gas turbine engine shroud sealing arrangement.

BACKGROUND OF THE ART

Over the years various sealing arrangements have been designed to seal the annular shrouds surrounding the tips of turbine blades. Feather seals are typically installed in the aft and forward rails of the shroud support structures to minimize cooling air leakage through the shroud segments.

A main disadvantage of such feather seals is that it provides for a multi-part sealing arrangement (e.g. 12–24 feather seals) which renders the assembly procedure more complex, thereby resulting in extra costs. Furthermore, feather slots must be machined in each shroud segments for allowing the feather seals to be positioned in the aft and forward rails of the outer shroud support, which further increases the manufacturing cost of the engine. Finally, such a multi-part sealing arrangement contributes to increase the overall weight of the gas turbine engine.

SUMMARY OF THE INVENTION

It is therefore an object of this invention to provide a new sealing arrangement which addresses the above mentioned concerns.

In one aspect, the present invention provides a turbine blade tip shroud assembly comprising an annular shroud support having at least one radially inner annular flange defining a groove, a shroud supportively engaged in said groove, said shroud having a platform, the platform having a hot gas path side and a back side, an annular gap being defined radially inwardly of said groove between said back side of said platform and a radially inwardly facing side of said at least one annular flange, and a ring seal having a spring-loaded annular sealing portion and a radial flange extending from one end of said spring-loaded annular sealing portion, the spring-loaded annular sealing portion extending axially in said annular gap in sealing engagement with said back side and said radially inwardly facing surface of said at least one annular flange, and wherein the radial flange is in axial abutment relationship with an axially facing surface of one of said shroud and said at least one annular flange of said shroud support.

In another aspect, the present invention provides a ring seal in combination with a turbine shroud adapted to surround a stage of turbine blades, the turbine shroud comprising a support ring and a shroud mounted within said support ring, the shroud comprising a platform having an aft overhanging portion, said aft overhanging portion having a gas path side and a back side opposite said gas path side, said back side defining with an opposed facing radially inner surface of said support ring an annular gap, said ring seal being mounted in said annular gap and maintained in sealing engagement with said radially inner surface of said support ring and said back side of said aft overhanging portion of said platform.

In another aspect, the present invention provides a method for sealing a turbine shroud comprising a platform overhanging portion having a gas path side and an opposed back side, the back side being spaced-radially inwardly from a radially inner surface of a surrounding support ring, the method comprising the step of mounting an annular seal in sealing engagement with said the back side of the platform overhanging portion and the radially inner surface of the surrounding support ring.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
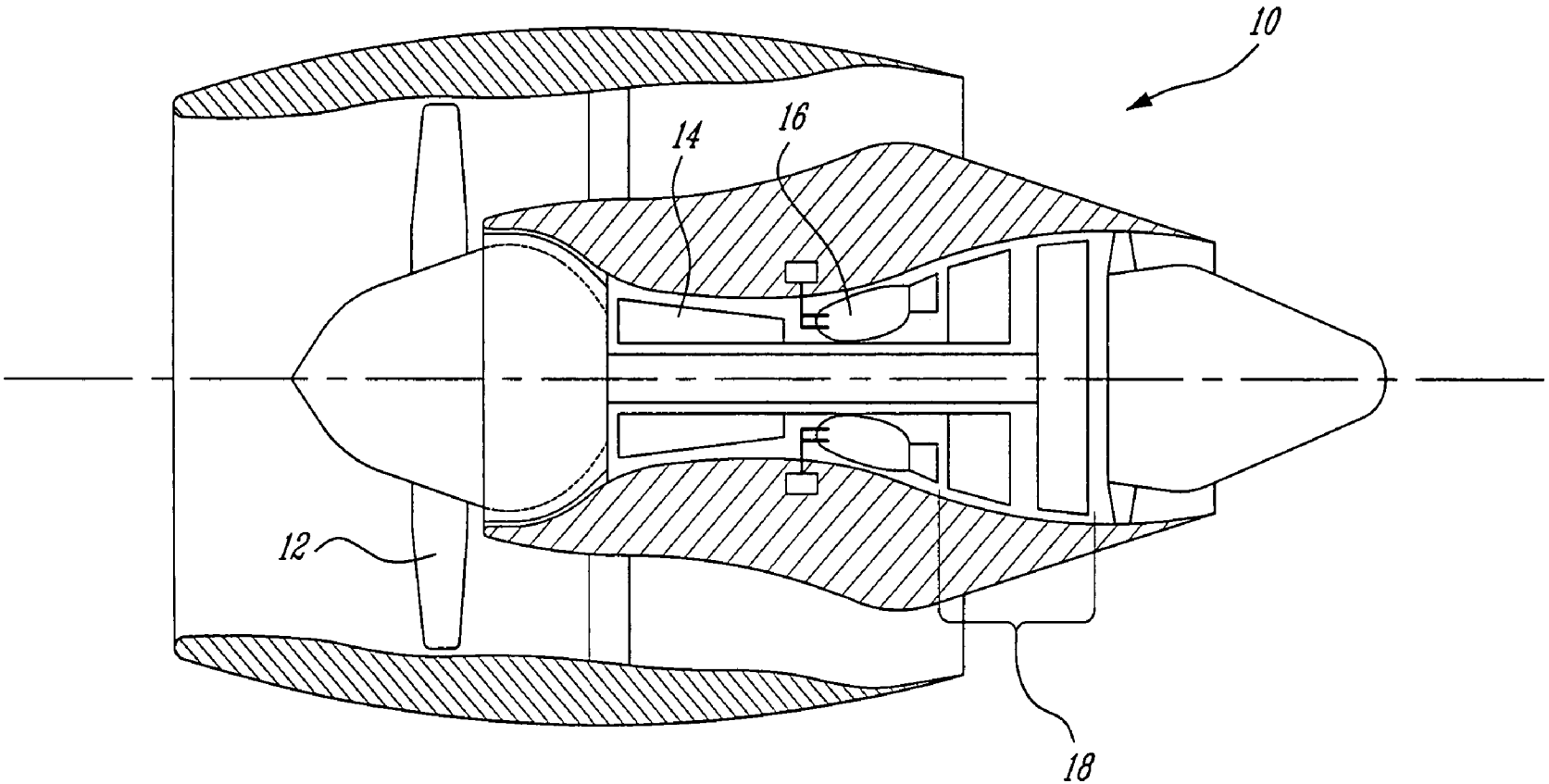
FIG. 1 is an axial cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The turbine section 18 comprises, among others, a turbine rotor mounted for rotation about a centerline axis of the engine 10. The turbine rotor comprises a plurality of circumferentially spaced-apart blades 22 (only one shown in FIG. 2) extending radially outwardly from a rotor disk. An annular turbine shroud 26 surrounds the tip of the blades 22. The turbine shroud 26 typically comprises a plurality of circumferentially adjoining segments 28 (only one shown in FIG. 2) forming a continuous 360 ° concentric annular band about the turbine blades 22.

Each shroud segment 28 comprises a platform 30 and a pair of retention hooks 32 and 34 extending radially outwardly from a back side 36 (i.e. the radially outwardly facing side) of the platform 30 opposite to a gas path side 38 thereof (i.e. the radially inwardly facing side). The platform 30 has an aft overhanging portion 40 extending axially rearward of the aft retention hook 34. The forward and aft retention hooks 32 and 34 are respectively provided with axially aft extending terminal components 32*a* and 34*a* conventionally axially engaged in respective forwardly facing annular grooves 42 and 44 defined by a pair of forward and aft annular flanges 46 and 48 extending integrally radially inwardly from a radially inner surface 50 of a surrounding annular shroud support 52.

Figure 2:
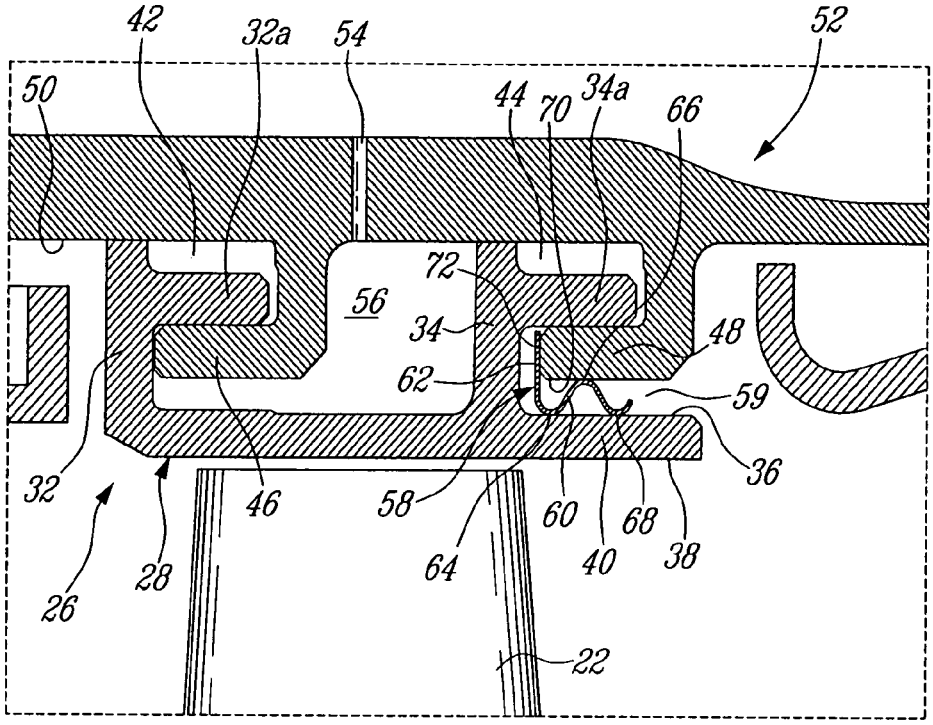
FIG. 2 is an enlarged fragmentary cross-sectional view of the turbine section showing details of a turbine shroud sealing arrangement in accordance with an embodiment of the present invention.

Holes 54 are defined in the shroud support 52 to allow cooling air to flow into the annular cavity 56 formed between the shroud 26 and the support structure 52. As shown in FIG. 2, a one-piece ring seal 58 extends in the annular gap 59 between the overhanging portion 40 of the platform 30 and the aft annular flange 48 to seal the cavity 56. The ring seal 58 has an axially extending annular wave-shaped component 60 and an annular axial retaining flange 62 extending radially outwardly from a forward end or upstream end of the axially wave-shaped component 60

The wave-shaped component 60 has first, second and third peaks 64, 66 and 68. The configuration of wave-shaped component 60 is such that the radial extent between top peak 66 and bottom peaks 64 and 68 is slightly greater than the radial dimension between the radially inwardly facing surface 70 of the aft flange 48 of the shroud support 52 and the back side 36 of the overhanging portion 40 of the shroud platform 30. The seal 58 is made up of a heat resistant material having an inherent resiliency suitable to maintain spring fitted continual contact with the opposed facing surfaces 36 and 70 of the gap 59. Thus, the wave-shaped component 60 is spring loaded between the aft overhanging portion 40 of the shroud platform 30 and the aft flange 48 of the shroud support 52 so that peaks 64, 66 and 68 are in continual contact with the opposed facing surfaces 36 and 70 of the annular gap 59. In addition to prevent cooling air leakage through the annular gap 59, the wave-shaped component 60 spring loads the shroud segments 28 radially inwardly. During engine operation, the wave-shaped component 60 will accommodate different thermal growth between the platform 30 and the aft flange 48.

As shown in FIG. 2, the axial retaining flange 62 axially abuts against a forward facing end surface 72 of the shroud support aft flange 48 for retaining the ring seal 58 against axially aft movement during engine operation. The use of such an axial retaining feature is advantageous in that it allows the ring seal 58 to be positioned about the overhanging portion 40 in a single step without having to machine any spring placement slot in the shroud segments 28, thereby contributing to reduce the overall engine manufacturing costs.

Figure 3:
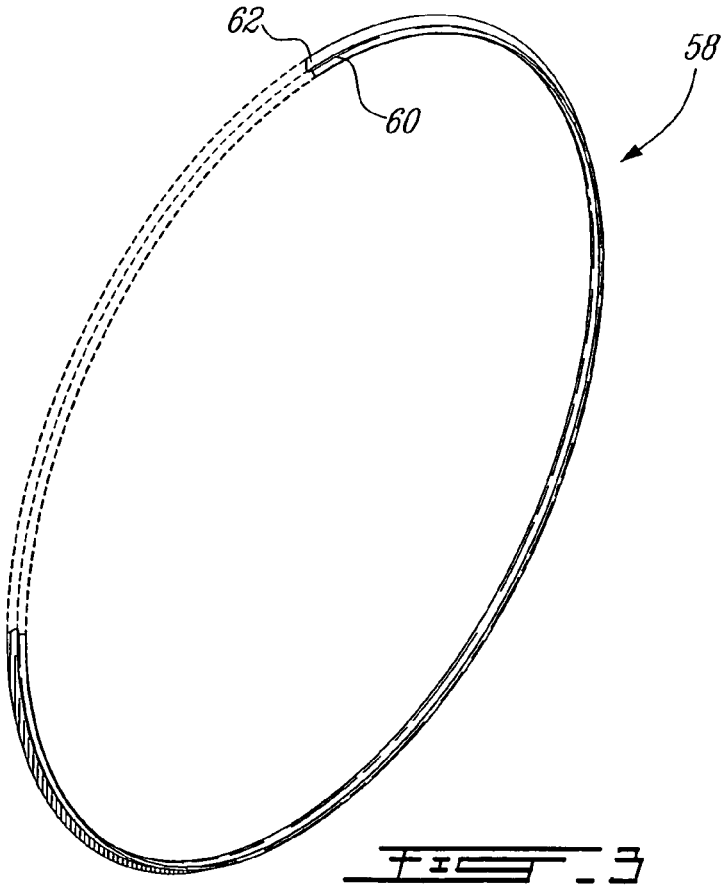
FIG. 3 is a perspective view of a one-piece ring seal in accordance with an embodiment of the present invention.

As shown in FIG. 3, the ring seal 58 may be constructed as a one-piece endless ring to be first installed in the annular shroud support 52 with the radially outwardly extending flange 62 thereof in axial abutment relationship with the forward facing end surface 72 of the annular aft flange 48. Then, the shroud segments 28 can be successively mounted to the shroud support 52. The use of a single piece seal is advantageous as compared to compared to conventional multi-pieces feather seals in that it greatly simplify the assembly procedures. Also, the spring seal 58 can be conveniently cold formed or rolled from a lightweight sheet metal blank, thereby providing a sealing arrangement which is cheaper and lighter than a typical feather seal arrangement.

The above description is meant to be exemplary only, and one skilled in the art will recognize that changes may be made to the embodiments described without department from the scope of the invention disclosed. For example, it will be appreciated that ring seal 58 is not limited to being installed to a high pressure shroud, but rather, it can be installed in other engine stages which exhibit similar problems and needs. Also, it is understood that the wave-shaped portion 60 could have more or less than three peaks. In fact, could have any configuration adapted to accommodate different thermal gradient between the engine parts to be sealed. Still other modifications which fall within the scope of the present invention will be apparent to those skilled in the art, in light of a review of this disclosure, and such modifications are intended to fall within the appended claims.

The invention claimed is:

1. A turbine blade tip shroud assembly comprising an annular shroud support having at least one radially inner annular flange defining a groove, a shroud supportively engaged in said groove, said shroud having a platform, the platform having a hot gas path side and a back side, an annular gap being defined radially inwardly of said groove between said back side of said platform and a radially inwardly facing side of said at least one annular flange, and a ring seal having a spring-loaded annular sealing portion and a radial flange extending from one end of said spring-loaded annular sealing portion, the spring-loaded annular sealing portion extending axially in said annular gap in sealing engagement with said back side and said radially inwardly facing surface of said at least one annular flange, and wherein the radial flange is in axial abutment relationship with an axially facing surface of one of said shroud and said at least one annular flange of said shroud support, wherein said spring-loaded annular sealing portion has a wave-shaped pattern including a pair of radially inwardly located peaks in contact with said back side of said platform and one radially outwardly located peak in contact with said radially inwardly facing surface of said at least one annular flange.

2. The shroud assembly as defined in claim 1, wherein said at least one annular flange comprises an aft flange, and wherein said platform has an aft overhanging portion, said ring seal being located between said aft overhanging portion and said aft flange.

3. The shroud assembly as defined in claim 1, wherein said radial flange extends radially outwardly from said spring loaded annular sealing portion, and wherein said axially facing surface forms part of said at least one radially annular flange.

4. The shroud assembly as defined in claim 3, wherein said ring seal is a one-piece endless member.

5. A ring seal in combination with a turbine shroud adapted to surround a stage of turbine blades, the turbine shroud comprising a supped ring and a shroud mounted within said support ring, the shroud comprising a platform having an aft overhanging portion, said aft overhanging portion having a gas path side and a back side opposite said gas path side, said back side defining with an opposed facing radially inner surface of said support ring an annular gap, said ring seal being mounted in said annular gap and maintained in sealing engagement with said radially inner surface of said support ring and said back side of said aft overhanging portion of said platform, wherein said support ring has an aft annular flange extending radially inwardly from an inner surface thereof, and wherein said annular gap is defined between said aft annular flange and said aft overhanging portion, and wherein said ring seal has a radial flange abutting against a forwardly axially facing surface of said aft annular flange.

6. A combination as defined in claim 5, wherein said ring seal is a one-piece endless member.

7. A combination as defined in claim 5, wherein said radial flange extends radially outwardly from a front end of a wave-shaped annular sealing portion having a pair of radially inwardly located peaks in contact with said back side of said overhanging portion and one radially outwardly located peak in contact with said radially inner surface of said support ring.

8. A method for sealing a turbine shroud assembly comprising a shroud and a shroud support, the shroud comprising a platform overhanging portion having a gas path side and an opposed back side, the back side being spaced-radially inwardly from a radially inner surface of an aft annular flange extending radially inwardly from an inner surface of the shroud support, the method comprising: mounting an annular seal in sealing engagement with said back side of the platform overhanging portion and the radially inner surface of the aft annular flange of the shroud support, and abutting a radial flange of the annular seal against a forwardly axially facing surface of the aft annular flange.

9. The method as defined in claim 8, wherein the annular seal is mounted in position within said shroud support before the shroud be mounted thereto.

* * * * *

UNITED STATES PATENT AND TRADEMARK OFFICE

CERTIFICATE OF CORRECTION

PATENT NO. : 7,217,089 B2
APPLICATION NO. : 11/034764
DATED : May 15, 2007
INVENTOR(S) : Eric Durocher and Martin Jutras It is certified that error appears in the above-identified patent and that said Letters Patent is hereby corrected as shown below:

Claim 5, column 4, line 34, delete “supped” insert -- support --

Signed and Sealed this

Twenty-eighth Day of August, 2007

JON W. DUDAS
*Director of the United States Patent and Trademark Office*